US010465700B2

(12) United States Patent
Hioki

(10) Patent No.: US 10,465,700 B2
(45) Date of Patent: Nov. 5, 2019

(54) BLOWING DEVICE

(71) Applicant: DENSO CORPORATION, Kariya, Aichi-pref. (JP)

(72) Inventor: Tetsuya Hioki, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 304 days.

(21) Appl. No.: 15/539,858

(22) PCT Filed: Dec. 24, 2015

(86) PCT No.: PCT/JP2015/006431
§ 371 (c)(1),
(2) Date: Jun. 26, 2017

(87) PCT Pub. No.: WO2016/116996
PCT Pub. Date: Jul. 28, 2016

(65) Prior Publication Data

US 2017/0350412 A1 Dec. 7, 2017

(30) Foreign Application Priority Data

Jan. 19, 2015 (JP) ..... 2015-007769

(51) Int. Cl.
*F04D 29/32* (2006.01)
*F04D 29/58* (2006.01)
(Continued)

(52) U.S. Cl.
CPC ..... *F04D 29/326* (2013.01); *F04D 29/164* (2013.01); *F04D 29/522* (2013.01);
(Continued)

(58) Field of Classification Search
CPC .... F04D 29/164; F04D 29/326; F04D 29/526; F04D 29/5833
See application file for complete search history.

(56) References Cited

U.S. PATENT DOCUMENTS 6,896,095 B2 * 5/2005 Shah ..... F01P 5/06 181/198
2007/0224044 A1 9/2007 Hong et al.
2014/0334917 A1 11/2014 Yoshida et al.

FOREIGN PATENT DOCUMENTS

JP 2003343494 A 12/2003
JP 2009531599 A 9/2009
(Continued)

*Primary Examiner* — Jason D Shanske
*Assistant Examiner* — Brian O Peters
(74) *Attorney, Agent, or Firm* — Harness, Dickey & Pierce, P.L.C.

(57) ABSTRACT

A blowing device includes an axil fan having a plurality of blades and causing an air to flow through the blowing device, and a fan shroud rotatably supporting the fan. The fan shroud includes a ring portion surrounding a circumference of the fan, and an air guide portion connecting an outer rim of the fan shroud and an inner rim of the ring portion. The fan shroud includes a specific rim portion that is a part of the outer rim of the fan shroud, a distance from the specific rim portion to the inner rim of the ring portion being shorter than other parts of the outer rim. The fan shroud includes a counter flow introduction passage provided in the air guide portion and extending from a position located inward of the specific rim portion. The blowing device is capable of limiting a rotation noise of the fan.

14 Claims, 6 Drawing Sheets

(51) Int. Cl.

| | |
|---|---|
| ***F04D 29/52*** | (2006.01) |
| ***F04D 29/16*** | (2006.01) |
| ***F04D 29/66*** | (2006.01) |

(52) U.S. Cl.
CPC ..... *F04D 29/526* (2013.01); *F04D 29/5833* (2013.01); *F04D 29/667* (2013.01)

(56) References Cited

FOREIGN PATENT DOCUMENTS

| | | | |
|---|---|---|---|
| JP | 2011052556 | A | 3/2011 |
| JP | 5227947 | B2 | 7/2013 |
| JP | 5549686 | B2 | 7/2014 |

* cited by examiner

BLOWING DEVICE

CROSS REFERENCE TO RELATED APPLICATIONS

This application is a U.S. National Phase Application under 35 U.S.C. 371 of International Application No. PCT/JP2015/006431 filed on Dec. 24, 2015 and published in Japanese as WO 2016/116996 A1 on Jul. 28, 2016. This application is based on and claims the benefit of priority from Japanese Patent Application No. 2015-007769 filed on Jan. 19, 2015. The entire disclosures of all of the above applications are incorporated herein by reference.

TECHNICAL FIELD

The present disclosure relates to a blowing device including a fan shroud provided so as to surround an outside of an axial fan.

BACKGROUND ART

A fan shroud that supports an axial fan cooling a radiator of a vehicle is described in Patent Document 1. The fan shroud has a part in which a gap in a radial direction between an outer rim of the fan shroud and a ring portion surrounding the axial fan in a radially outer side is large, and a part in which the gap is small. An air guide portion is provided between an outer rim of the fan shroud and the ring portion. Areas of the air guide portion corresponding to an upper part and a lower part of the fan shroud are small, and areas of the air guide portion corresponding to a left part and a right part are large, for example.

In recent years, due to high requirement of quietness in a vehicle, peak sounds regarding a rotation noise of the fan such as peak noises of 1-order and n-order is required to be reduced. The rotation noise is remarkably increased by interference of a rotating body and air around the rotating body, and single frequency element becomes particularly high sound pressure.

When a large area portion and a small area portion are provided in the air guide portion of the fan shroud as described in Patent Document 1, a velocity of a main air flow flowing to an inside of the ring portion in a direction along a rotation axis when a blade of the fan passes the large area portion is remarkably different form the velocity of the main air flow when the blade passes the small area portion. In the large area portion of the air guide portion, the main air flow flows in a direction inclined at a large angle with respect to the rotation axis. In the small area portion of the air guide portion, the main air flow flows in a direction slightly inclined with respect to the rotation axis. Therefore, the velocity of the main air flow in the direction along the rotation axis, i.e. a velocity vector in the direction along the rotation axis is large in the small area portion.

Since a pressure difference between an upstream side and a downstream side of the blade of the fan is generated, a counter air flow flowing toward the upstream side along the rotation axis is generated in the downstream side of the blade. A collision of the counter air flow and the main air flow causes a swirl. Since the velocity of the main air flow in the direction along the rotation axis is large around the small area portion of the air guide portion, the swirl is likely to be generated on the downstream side of the blade around the small area portion. In contrast, around the large area portion, since the velocity of the main air flow in the direction along the rotation axis is small, the swirl is likely to be generated on the upstream side of the blade. Accordingly, effects of the swirl on the fan shroud around the large area portion are small, and effects of the swirl on the fan shroud around the small area portion are large. Accordingly, around the small area portion, a negative pressure area is generated on the surface of the shroud due to an interference of the swirl, and a peak sound of n-order increases when the blade passes the small area portion, and accordingly a rotation noise may be generated.

PRIOR ART DOCUMENT

Patent Document

Patent Document 1: Japanese Patent No. 5549686

SUMMARY OF THE INVENTION

The inventor has confirmed, through numerical analyses analyzing a pressure distribution around the surface of the shroud, that the negative pressure area grows around the small area portion rather than around the large area portion to generate a remarkably non-uniform pressure distribution around the ring portion in a circumferential direction.

As described above, the air flowing along the air guide portion of the fan shroud to the inside of the ring portion forms a characteristic air flow due to sizes of the air guide portion provided around the ring portion and positional relationships between the air guide portion and the blade of the fan. In the blowing device having the fan shroud, the noises caused by the relationships between the main air flowing to the inside of the ring portion and the counter air are required to be reduced.

In consideration of the above-described points, it is an objective of the present disclosure to provide a blowing device having a fan shroud that is capable of decreasing a level of a peak noise regarding rotation noises.

A blowing device according to a first aspect of the present disclosure includes an axial fan having a plurality of blades and causing an air to flow through a heat exchanger, and a fan shroud rotatably supporting the fan. The fan shroud includes: a ring portion having a cylindrical shape extending in a direction along a rotation axis of the fan, the ring portion surrounding a circumference of the fan with a gap between the circumference of the fan and the ring portion; an air guide portion connecting an outer rim of the fan shroud and an inner rim of the ring portion, the air guide portion guiding a drawn air drawn by the fan toward an inside of the ring portion. The fan shroud includes a specific rim portion that is a part of the outer rim of the fan shroud, a distance from the specific rim portion to the inner rim of the ring portion being shorter than other parts of the outer rim. The fan shroud includes a counter flow introduction passage provided in the air guide portion and extending in a rotation direction of the fan from a position located inward of the specific rim portion, the counter flow introduction passage being located downstream of an upstream end of a tip of the fan. The counter flow introduction passage is a passage through which the air flows in an opposite direction from a flow direction of the drawn air when the fan rotates.

A blowing device according to a second aspect of the present disclosure includes an axial fan having a plurality of blades, and a fan shroud rotatably supporting the fan. The fan shroud includes: a ring portion having a cylindrical shape extending in a direction along a rotation axis of the fan, the ring portion surrounding a circumference of the fan with a gap between the circumference of the fan and the ring portion; an air guide portion connecting an outer rim of the fan shroud and an inner rim of the ring portion, the air guide portion guiding a drawn air drawn by the fan toward an inside of the ring portion. The fan shroud includes a specific rim portion that is a part of the outer rim of the fan shroud, a distance from the specific rim portion to the inner rim of the ring portion being shorter than other parts of the outer rim. The fan shroud includes a counter flow introduction passage provided in the air guide portion and extending in a rotation direction of the fan from a position located inward of the specific rim portion, the counter flow introduction passage being located downstream of an upstream end of a tip of the fan. The counter flow introduction passage is a passage through which the air flows in an opposite direction from a flow direction of the drawn air when the fan rotates.

As described above, in the blowing device according to the present disclosure, a negative pressure area is likely to grow inside the specific rim portion of the outer rim of the shroud in which the distance from the inner rim of the ring portion is short compared to the other parts of the outer rim, i.e. the small area portion of the air guide portion, due to interference of a swirl. Around the small area portion of the air guide portion, a peak noise increases when the blade passes the small area portion due to the growth of the negative pressure area, and a rotation noise may be large. This is caused by interference of a swirl with the shroud, the swirl is generated by a collision of a counter air flow and a main air flow. The counter air flow is generated by a pressure difference between an upstream side and a downstream side of the blade, and the main air flow flows to the inside of the ring portion.

According to the blowing device of the present disclosure, an additional counter air flow flowing toward a front side of the shroud flows through a counter flow introduction passage extending from the inside of the specific rim portion in the rotation direction of the fan, and accordingly the counter air flow and the main air flow collide with each other in more upstream area. Since the interference of the swirl generated by the collision can be limited, the growth of the negative pressure area around the small area portion of the air guide portion can be limited. According to these effects, the peak noise can be limited, and accordingly the blowing device capable of decreasing the rotation noise of fan can be provided.

EMBODIMENTS FOR EXPLOITATION OF THE INVENTION

Figure 1:
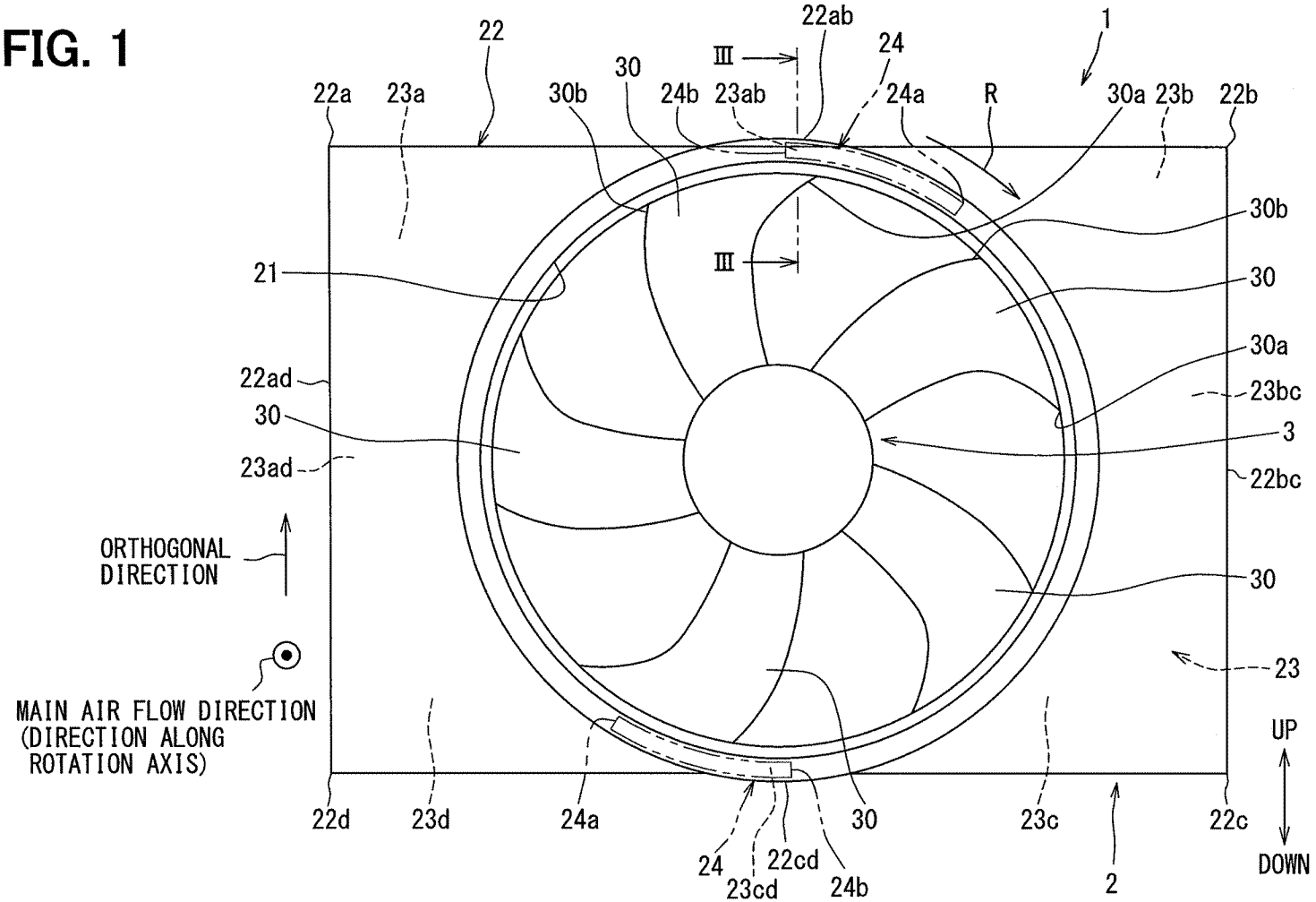
FIG. 1 is a posterior diagram illustrating a blowing device according to a first embodiment of the present disclosure.

Hereinafter, multiple embodiments for implementing the present invention will be described referring to drawings. In the respective embodiments, a part that corresponds to a matter described in a preceding embodiment may be assigned the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

A blowing device 1 according to a first embodiment of the present disclosure will be described below referring to FIGS. 1 to 6. In the first embodiment, a device will be described as an example of the blowing device, the device providing a blown air to a radiator that is provided in a vehicle for cooling an engine, for example.

As shown in FIG. 1, the blowing device 1 includes an axial fan 3 and a fan shroud 2, the fan shroud 2 supporting a motor driving the fan 3 rotationally and guiding an air drawn by the fan 3. The fan 3 includes a boss portion that is a center of a rotation, and multiple blades 30 radially extending from the boss portion. One end of the blade 30 is integrated with the boss portion, and the other end is integrated with a ring portion 31 of the fan 3, the ring portion 31 having a circular shape. The fan 3 includes the motor generating a rotational force. The motor includes a motor shaft that is a rotation axis. The motor shaft and the boss portion are connected to each other by a fixation member. The motor is an electric motor such as a direct-current ferrite motor. The motor is connected to a harness portion supplying electricity to an armature, and the harness portion is connected to a battery of the vehicle through a connector, for example.

The fan 3 is positioned downstream of a radiator 4 that is an example of a heat exchanger in regard to an air flow. The motor is driven rotationally, and the fan 3 draws an outside air from a grille located in a front side of the vehicle toward the engine.

The fan shroud 2 supports the fan 3 rotatably and surrounds a circumference of the fan 3 supplying the cooling air to the radiator 4 that dissipates heat of an engine cooling water. The fan shroud 2 supports and fixes the motor of the fan 3, and the fan shroud 2 is integrated with the radiator 4. For example, the fan shroud 2 includes a lower side attachment portion and an upper side attachment portion that include a through-hole through which a screw is screwable. The upper side attachment portion is positioned in an upper part of the fan shroud 2 in a vertical direction, and the lower side attachment portion is positioned in a lower part of the fan shroud 2 in the vertical direction. The fan shroud 2 is integrated with the radiator 4 by screwing a screw to a female thread portion provided in the radiator 4. The screw extends through the through-hole of the lower side attachment portion or the upper side attachment portion.

The fan shroud 2 has a rectangular shape in which at least one fan 3 is provided, the fan causing the cooling air to pass through a heat exchange portion of the radiator 4 performing a heat exchange. The heat exchange portion of the radiator 4 includes multiple tubes in which the cooling water flows, and an outer fin provided between the tubes integrally with the tubes. A water pump is driven to flows the cooling water from the engine into an inlet side tank of the radiator 4 through a radiator cycle, and subsequently, the cooling water flows in the tubes of the heat exchange portion. The cooling water flows out through an outlet side tank and returns to the engine after being cooled by a heat exchange with an exterior air blown by the fan 3.

An outline of the fan shroud 2 is a rectangular shape in an anterior view. The fan shroud 2 includes a ring portion 21 surrounding a circumference of the fan 3 with a gap between a tip of the fan 3 and the ring portion 21, and an air guide portion 23 guiding an air drawn by the fan 3. The fan shroud 2 has a rectangular shape, a length of the rectangular shape in an up-down direction being larger than that in a left-right direction. A surface area of the air guide portion 23 located above and below the ring portion 21 is smaller than that located in a left side and a right side of the ring portion 21.

The air guide portion 23 connects an outer rim 22 of the fan shroud 2 and an inner rim of the ring portion 21, and the air guide portion 23 guides the air drawn by the fan 3 to an inside of the ring portion 21. Accordingly, the air guide portion 23 works as a wind tunnel that collects a main air (drawn air) drawn from a front side of the fan 3 from the outer rim 22 of the fan shroud 2 to the inside of the ring portion 21 smoothly. Moreover, the fan shroud 2 includes a motor attachment portion to which the motor of the fan 3 is attached and multiple motor stays radially extending from the motor attachment portion. The ring portion 21 has a circular cylindrical shape surrounding the circumference of five blades of fan 3 (circumference of the fan 3), and the ring portion 21 is integrated with an end portion of the motor stay in the radial direction, and the ring portion 21 supports the motor attachment portion through the motor stay.

The air guide portion 23 connects the outer rim 22 of the fan shroud 2 and the ring portion 21, and the air guide portion 23 is inclined or curved smoothly. The air guide portion 23 functions to effectively send the exterior air to an entire surface of the heat exchange portion of the radiator 4. A part of the air guide portion 23 from an end of the outer rim 22 around the radiator to an inner rim 21*a* of the ring portion 21 forms a wind tunnel portion, and contributes to forming an air flow drawing the exterior air effectively. The fan shroud 2 is a resin molded product, for example, and made by injection molding using a metal die. In the resin molded product, glass fiber or talc is mixed to polypropylene resin to reinforce the resin molded product, for example.

As shown in FIG. 1, the outer rim 22 of the fan shroud 2 has a rectangular shape having four corner portions 22*a*, 22*b*, 22*c*, and 22*d*. Between the corner portion 22*a* and the corner portion 22*b* which are located in an upper part of the fan shroud 2, a specific rim portion 22*ab* in which a distance from the ring portion 21 is the shortest between the corner portion 22*a* and the corner portion 22*b* is provided. The specific rim portion 22*ab* is a part of the outer rim 22 in which the distance from the ring portion 21 is the shortest between the corner portion 22*a* and the corner portion 22*b*. Between the corner portion 22*c* and the corner portion 22*d* which are located in a lower part of the fan shroud 2, a specific rim portion 22*cd* in which a distance from the ring portion 21 is the shortest between the corner portion 22*c* and the corner portion 22*d* is provided. The specific rim portion 22*cd* is a part of the outer rim 22 in which the distance from the ring portion 21 is the shortest between the corner portion 22*c* and the corner portion 22*d*. The specific rim portion 22*ab* extends along a shape of an inner peripheral surface of the ring portion 21, and the specific rim portion 22*ab* protrudes above the corner portions 22*a*, 23*b*. The specific rim portion 22*cd* extends along the shape of the inner peripheral surface of the ring portion 21, and the specific rim portion 22*cd* protrudes below the corner portions 22*c*, 22*d*.

Distances from the corner portion 22*a* and the corner portion 22*b* to the ring portion 21 are the longest in a part of the outer rim 22 extending from the corner portion 22*a* to the corner portion 22*b*, and the distances are longer than the distance from the specific rim portion 22*ab* to the ring portion 21. Accordingly, a small area portion 23*ab* that is one of areas having the smallest surface area between the corner portion 22*a* and the corner portion 22*b* is provided in a part of the air guide portion 23 connecting the specific rim portion 22*ab* and the ring portion 21. The small area portion 23*ab* corresponds to an inside part of the air guide portion 23 positioned inside the specific rim portion 22*ab*.

A large area portion 23*a* that has a surface area larger than the small area portion 23*ab* is provided in a part of the air guide portion 23 connecting the corner portion 22*a* and the ring portion 21. A large area portion 23*b* that has a surface area larger than the small area portion 23*ab* is provided in a part of the air guide portion 23 connecting the corner portion 22*b* and the ring portion 21. Upstream surfaces of the large area portion 23*a* and the small area portion 23*ab* which have smooth shapes are connected to each other to be formed integrally with each other. Upstream surfaces of the small area portion 23*ab* and the large area portion 23*b* which have smooth shapes are connected to each other to be formed integrally with each other.

Distances from the corner portions 22*b*, 22*c* to the ring portion 21 are the longest in a part of the outer rim 22 connecting the corner portion 22*b* and the corner portion 22*c*. A small area portion 23*bc* whose surface area is the smallest between the corner portion 22*b* and the corner portion 22*c* is provided in a part of the air guide portion 23 that connects the ring portion 21 and a medium portion 22*bc* located in a medium position between the corner portion 22*b* and the corner portion 22*c*. A large area portion 23*c* that has a surface area larger than the small area portion 23*bc* is provided in a part of the air guide portion 23 connecting the corner portion 22*c* and the ring portion 21. Upstream surfaces of the large area portion 23*b* and the small area portion 23*bc* which have smooth shapes are connected to each other to be formed integrally with each other. Upstream surfaces of the small area portion 23*bc* and the large area portion 23*c* which have smooth shapes are connected to each other to be formed integrally with each other.

Distances from the corner portion 22*c* and the corner portion 22*d* to the ring portion 21 is the longest in a part of the outer rim 22 connecting the corner portion 22*c* and the corner portion 22*d*, and the distances are longer than the distance from the specific rim portion 22*cd* to the ring portion 21. Accordingly, a small area portion 23*cd* that is one of areas having the smallest surface area between the corner portion 22*c* and the corner portion 22*d* is provided in a part of the air guide portion 23 connecting the specific rim portion 22*cd* and the ring portion 21. The small area portion 23*cd* corresponds to an inside part of the air guide portion 23 positioned inside the specific rim portion 22*cd*. A large area portion 23*d* that has a surface area larger than the small area portion 23*cd* is provided in a part of the air guide portion 23 connecting the corner portion 22*d* and the ring portion 21. Upstream surfaces of the large area portion 23*c* and the small area portion 23*cd* which have smooth shapes are connected to each other to be formed integrally with each other. Upstream surfaces of the small area portion 23*cd* and the large area portion 23*d* which have smooth shapes are connected to each other to be formed integrally with each other.

Distances from the corner portions 22*d*, 22*a* to the ring portion 21 are the longest in a part of the outer rim 22 connecting the corner portion 22*d* and the corner portion 22*a*. A small area portion 23*ad* whose surface area is the smallest between the corner portion 22*d* and the corner portion 22*a* is provided in a part of the air guide portion 23 that connects the ring portion 21 and a medium portion 22*ad* located in a medium position between the corner portion 22*d* and the corner portion 22*a*. The large area portion 23*d* and the large area portion 23*a* have surface areas larger than the small area portion 23*ad*. Upstream surfaces of the large area portion 23*d* and the small area portion 23*ad* which have smooth shapes are connected to each other to be formed integrally with each other. Upstream surfaces of the small area portion 23*ab* and the large area portion 23*a* which have smooth shapes are connected to each other to be formed integrally with each other.

Figure 2:
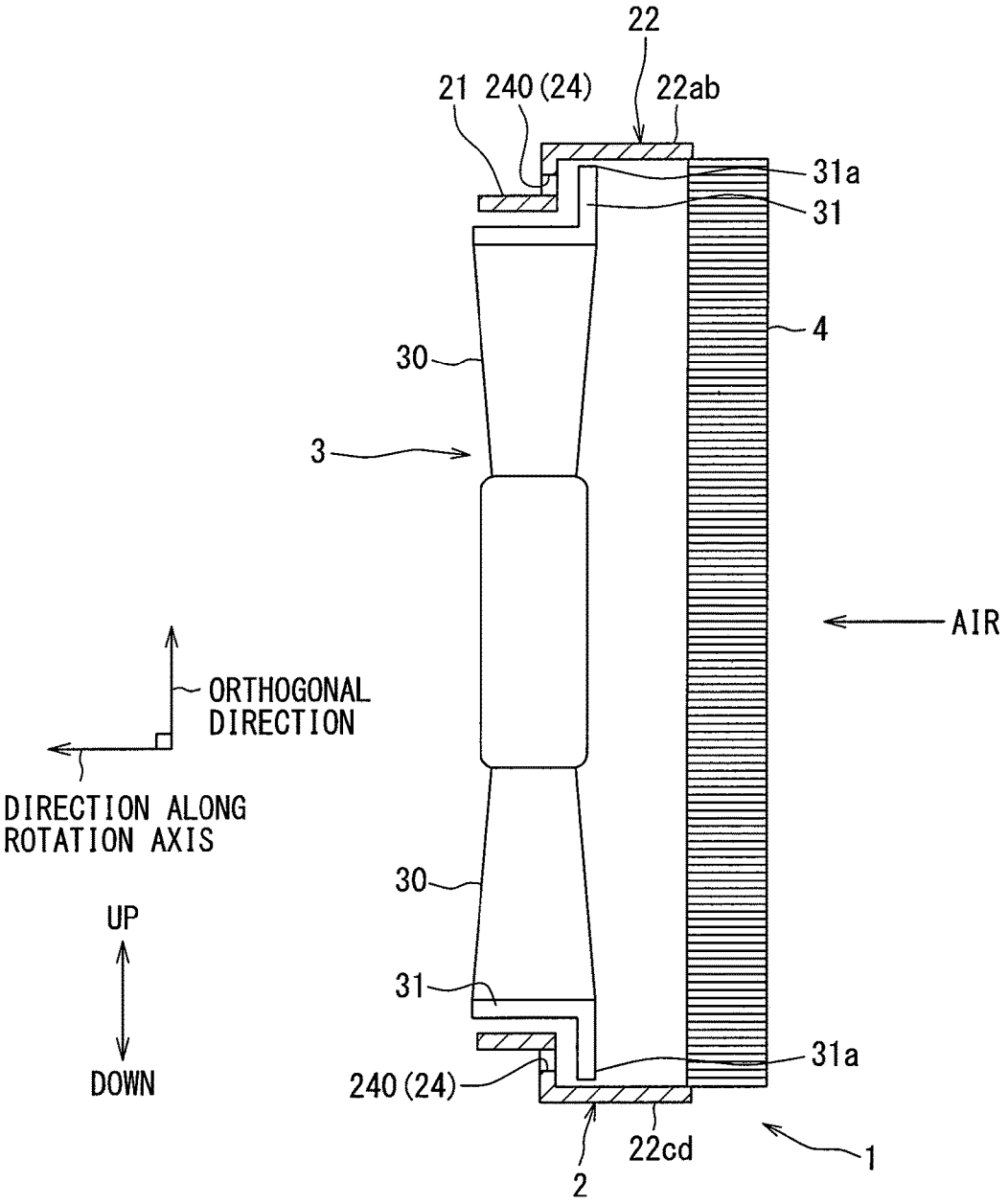
FIG. 2 is a sectional diagram illustrating the blowing device according to the first embodiment.
Figure 3:
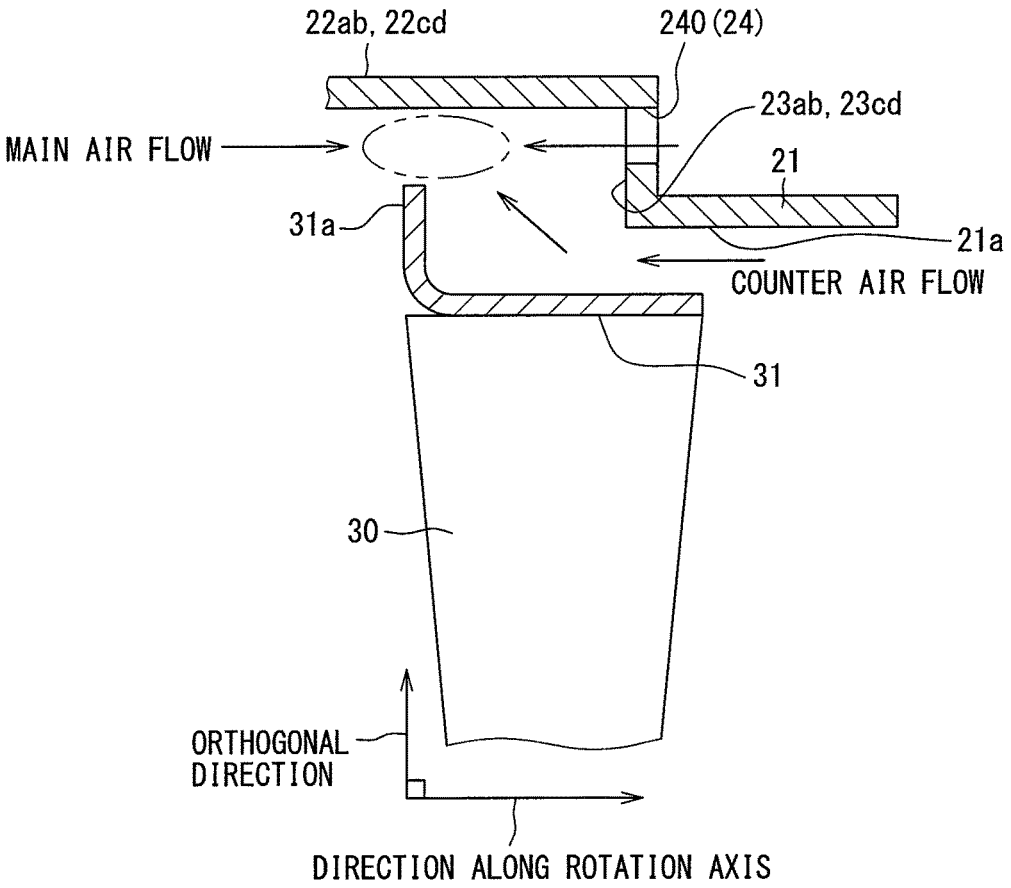
FIG. 3 is a sectional diagram taken along a line III-III of FIG. 1.
Figure 4:
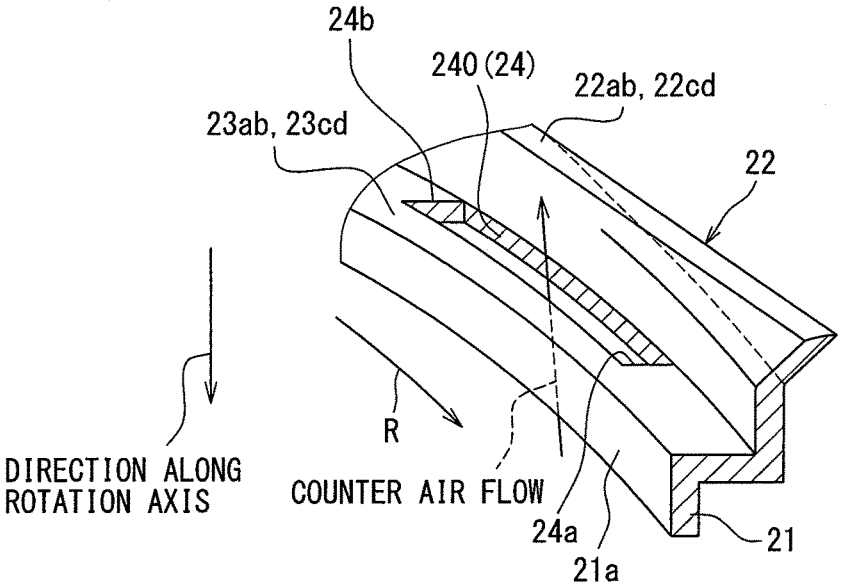
FIG. 4 is a diagram illustrating a counter air flow introduction passage that enhances a counter air flow and a vicinity of the counter air flow introduction passage, according to the first embodiment.

The fan shroud 2 includes a counter flow introduction passage 24 through which the air flows back from a back side, i.e. downstream side, of the fan shroud 2 toward a front side of the fan shroud 2. The counter flow introduction passage 24 is a passage for guiding the air from the back side toward the front side of the fan shroud 2, the air flowing in an opposite direction from a main air flow generated when the fan 3 rotates. As shown in FIGS. 2 and 3, the counter flow introduction passage 24 is provided in the fan shroud 2 and positioned downstream of a fan front rim 31*a* that is an upstream end of an outer circumference of the fan 3. As shown in FIGS. 1 and 4, the counter flow introduction passage 24 is provided at least in the small area portion 23*ab* located inside the specific rim portion 22*ab* and the small area portion 23*cd* located inside the specific rim portion 22*cd*. FIG. 4 is a perspective diagram illustrating the counter flow introduction passage 24, a part of which is cut away.

A length of the counter flow introduction passage 24 in a circumferential direction, i.e. a length in a rotation direction, is set according to an amount of the air which is blown by the blowing device 1, size relationships between the small area portions and the large area portions, and an acceptable level of a rotation noise, for example. The length of the counter flow introduction passage 24 in the circumferential direction may be set as shown in FIG. 1. According to this length, when a leading edge 30*a* of one blade 30 in a rotation direction R overlaps a tail end 24*b* of the counter flow introduction passage 24 in the rotation direction R, a trailing edge 30*b* of another blade 30 being next to and ahead of the one blade 30 in the rotation direction R does not overlap the counter flow introduction passage 24. A distance between the two blades 30 next to each other in the rotation direction R may be longer than a length of the counter flow introduction passage 24 in the rotation direction R. The distance between the blades 30 in the rotation direction R may be a distance between outermost parts of the blades 30 in a radial direction.

A distance in the circumferential direction between the leading edge 30*a* of any one of blades 30 and the trailing edge 30*b* of another blade 30 being next to and ahead of the one of blades 30 in the rotation direction R is equal to or longer than a distance between a front end 24*a* and the tail end 24*b* of the counter flow introduction passage 24 in the circumferential direction. The length of the counter flow introduction passage 24 in the circumferential direction may be set such that such relationships hold. When the trailing edge 30*b* of one blade 30 overlaps the counter flow introduction passage 24 in the radial direction, the leading edge 30*a* of another blade 30 behind the one blade 30 does not overlap the counter flow introduction passage 24 in the radial direction.

As shown in FIG. 4, an angle of an inner peripheral surface of the outer rim 22 against a rotation axis gradually increases from the tail end 24*b* to the front end 24*a* of the counter flow introduction passage 24. Accordingly, an inflow angle of the main air flow against the rotation axis increases from the specific rim portion 22*ab* and 22*cd* toward the rotation direction, and a velocity of the main air flow in direction along the rotation axis decreases. A part of the inner peripheral surface of the outer rim 22 extending from the specific rim portion 22*ab* and 22*cd* in the rotation direction is connected to a surface of the large area portion smoothly.

The counter flow introduction passage 24 is a passage defined by a through-hole 240 having a slit shape extending through the fan shroud 2, and the counter flow introduction passage 24 has a predetermined length in the circumferential direction (rotation direction R). The through-hole 240 can be provided so as to extend through a part connecting the ring portion 21 and the outer rim 22, as shown in FIGS. 3 and 4. When the part where the through-hole is provided has a surface extending along a direction perpendicular to the rotation axis of the fan 3, the counter air flow introduced through the through-hole 240 can flow in an opposite direction from the main air flow, and the counter air flow and the main air flow collide with each other effectively. According to this, since a vortex generated by the collision of the airs can be generated in a more forward part, i.e. more upstream part of the air flow, an interference of the vortex with the fan shroud 2 can be limited. Accordingly, a growth of a negative pressure that is likely to be generated around the small area portion 23*ab* and 23*cd* can be limited.

Next, phenomena discovered by studies by the inventor will be described below referring to FIGS. 3, 5 and 6. When the blowing device 1 is driven to rotate the fan 3, the exterior air is drawn to the heat exchange portion of the radiator 4. The air drawn to the heat exchange portion flows around tubes and outer fins and passes through the heat exchange portion in the direction along the rotation axis.

The air flowing along the surface of the air guide portion 23 toward the ring portion 21 generates two different air flows, one passing through the small area portions 23*ab* and 23*cd*, the other passing through the large area portions 23*a*, 23*b*, 23*c* and 23*d*. Since the air passing through the large area portion flows along the surface of the large area portion inclined with respect to the rotation axis at a large angle, the inflow angle of the main air flow is inclined with respect to the rotation axis at a large angle, as shown in FIG. 5. In contrast, since the air passing through the small area portion flows along the surface of the small area portion slightly inclined with respect to the rotation axis, the inflow angle of the main air flow is along the rotation axis, as shown in FIGS. 3 and 6.

Figure 5:
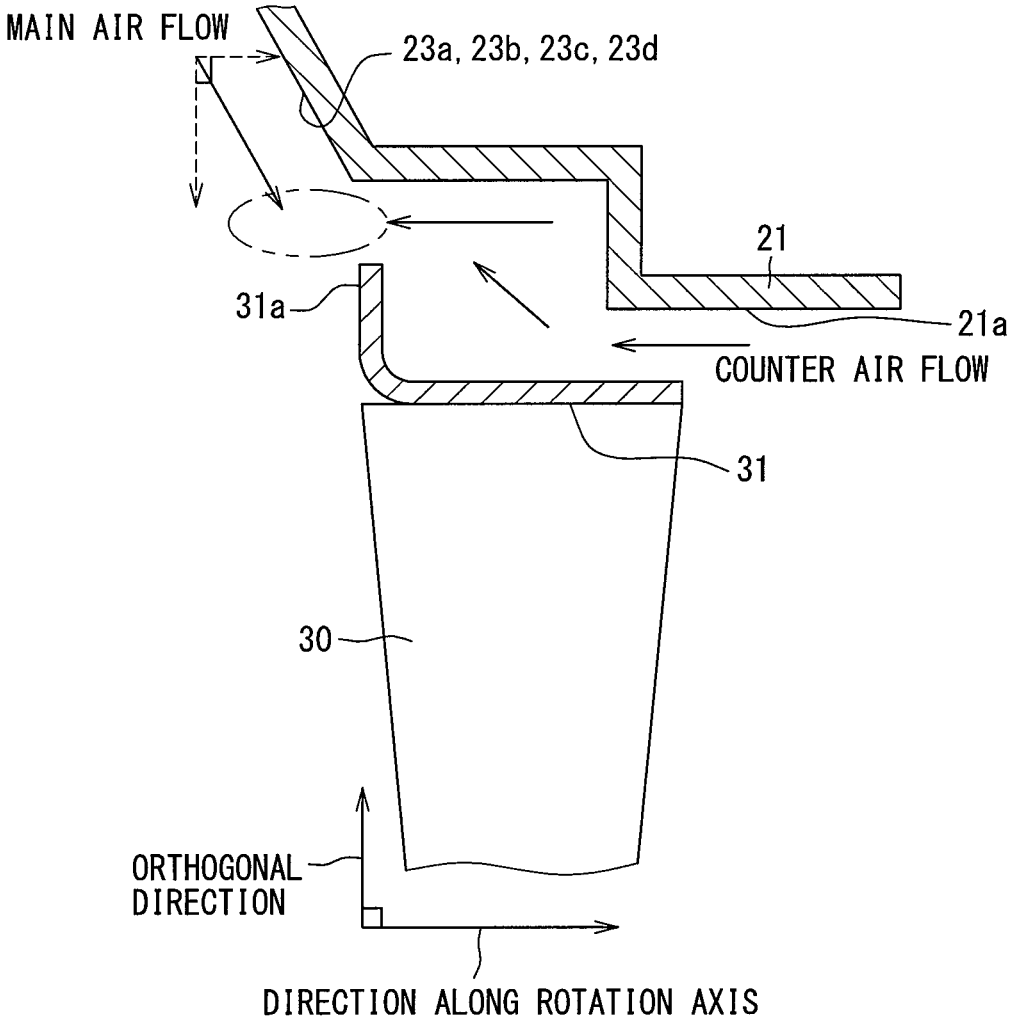
FIG. 5 is a sectional diagram illustrating a part of the blowing device in which the counter air flow introduction passage is not provided, according to the first embodiment.
Figure 6:
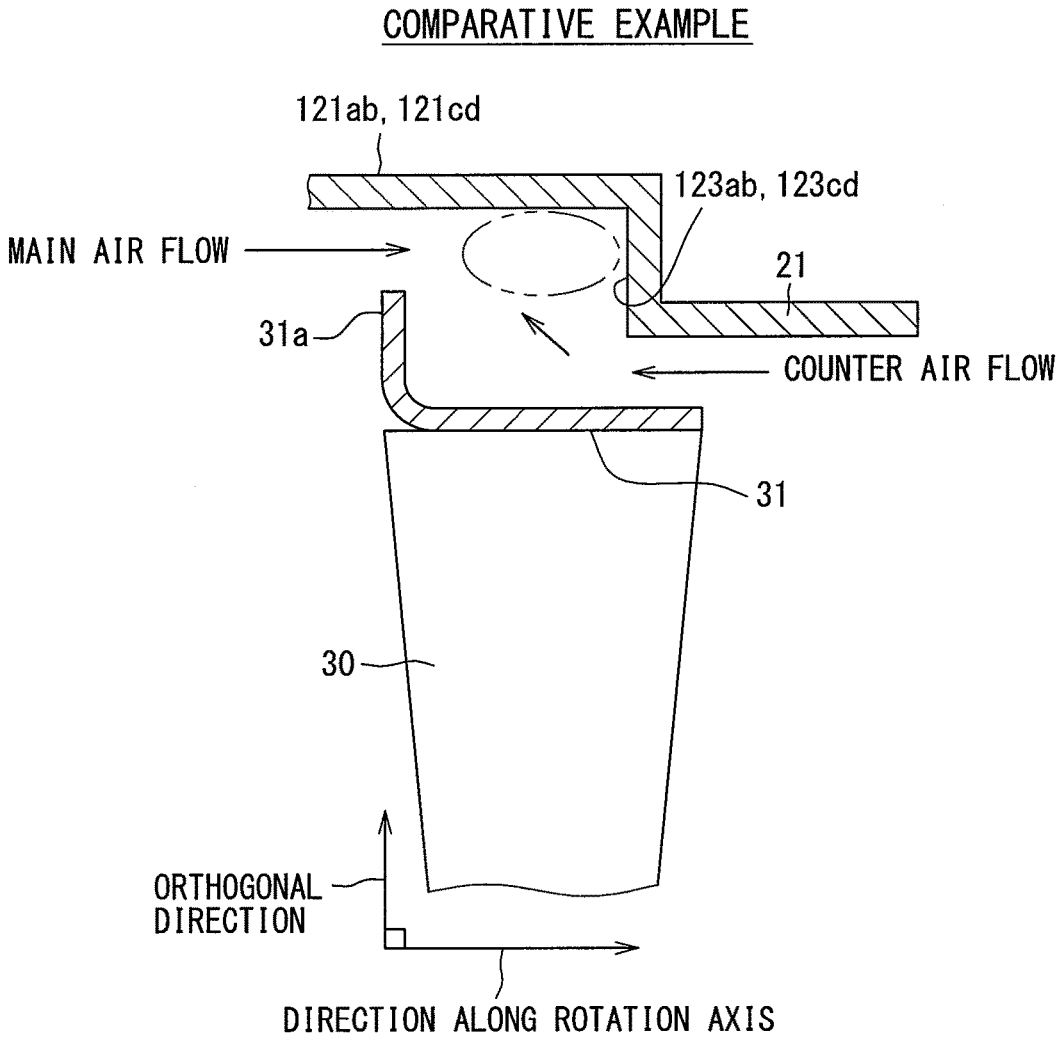
FIG. 6 is a sectional diagram illustrating a part of the blowing device in which a gap between an outer rim of a fan shroud and a ring portion is small, according to a comparative example.

Since the inflow angle of the main air passing through the large area portion is inclined with respect to the rotation axis at a large angle, a velocity of the main air flow in the direction of the rotation axis indicated by a dashed line in FIG. 5 decreases. The counter air flow generated by a pressure difference between an upstream side and a downstream side of the blade 30 of the fan 3 flows from the downstream side toward the upstream side of the blade 30 along the rotation axis. The counter air flow flows along the inner peripheral surface of the ring portion 21 in the direction along the rotation axis, and the counter air flow collide with the main air flow. Since the velocity of the main air flow passing through the large area portion in the direction along the rotation axis is small, the position where the airs collides with each other is close to the fan front rim 31*a*, as indicated by a line in FIG. 5 having alternate long dashes and pairs of short dashes. Accordingly, the swirl caused by the collision of the airs can be generated in a position where effects of the swirl on the fan shroud 2 are small. Therefore, the negative pressure caused by the swirl can be unlikely to grow around the surface of the large area portion of the shroud.

A collision of the main air flow and the counter air flow around an air guide portion according to a comparative example shown in FIG. 6 will be described below. As described above, the main air flows along the specific rim portion 121*ab* and 121*cd* in the direction along the rotation axis in a fan shroud of the comparative example (a fan shroud without the counter air introduction passage 24). Accordingly, a velocity of the main air flow in the direction along the rotation axis is large, and a collision of the main air flow and the counter air flow can be generated in a position close to the surface of the small area portions 123*ab* and 123*cd*. Accordingly, the swirl caused by the collision of the airs is generated where effects of the swirl on the fan shroud 2 are large. In the fan shroud according to the comparative example, a negative pressure area may be likely to be generated on a part of the surface of the shroud inside the specific rim portion.

In the fan shroud according to the comparative example, since the negative pressure area grows inside the specific rim portion while the negative pressure area is unlikely to grow around the large area portion, a pressure distribution around the ring portion in the circumferential direction becomes very non-uniform. The growth of the negative pressure area causing the non-uniform pressure distribution causes a rotation noise of the blowing device.

According to the first embodiment, since the blowing device 1 includes the counter flow introduction passage 24 introducing the counter air flow toward the fan front rim 31*a* of the fan 3 positively, the area where the swirl is generated is moved to an area where the effects of the swirl on the fan shroud 2 are small. Since the counter air flow flows from the back side of the fan shroud 2 toward the fan front rim 31*a* through the through-hole 240, the amount of the counter air flow increases compared to the fan shroud of the comparative example. According to this, the collision of the main air flow and the counter air flow occurs in a position apart from the surface of the small area portions 23*ab* and 23*cd*. Accordingly, the swirl caused by the collision of the airs can be generated in more forward area of the fan compared to a case where the counter flow introduction passage 24 is not provided, i.e. the area where the effects of the swirl on the fan shroud 2 are small.

Next, effects of the blowing device 1 of the first embodiment will be described below. The fan shroud 2 includes the ring portion 21 surrounding the outer circumference of the fan 3 with a gap between the fan shroud 2 and the outer circumference of the fan 3, the ring portion 21 extending in the direction along the rotation axis, and the air guide portion 23 connecting the outer rim 22 and the ring portion 21 to guide the air toward the inside of the ring portion 21. The fan shroud 2 includes the specific rim portions 22*ab*, 22*cd* where the distance from the inner rim 21*a* of the ring portion 21 is shorter than other part of the outer rim 22. The fan shroud 2 is a passage located downstream of the upstream end of the tip of the fan 3, and the fan shroud 2 includes the counter flow introduction passage 24 extending in the rotation direction from the part inside the specific rim portions 22*ab*, 22*cd*.

According to these configurations, the amount of the counter air flow flowing toward the front side of the fan shroud 2 can be increased by the counter flow introduction passage 24 extending in the rotation direction of the fan from the part inside the specific rim portions 22*ab*, 22*cd* can be increased. Therefore, the velocity of the counter air flow increases compared to the fan shroud of the comparative example, and the counter air flow and the main air flow collides with each other in a more upstream area. Accordingly, since the effects, on the fan shroud 2, of the swirl generated by the collision can be limited, the growth of the negative pressure area around the small area portions 23*ab*, 23*cd* can be limited. Since a peak noise of n-order generated every time the blade 30 rotates can be decreased, the blowing device 1 capable of reducing the rotation noise of the fan 3 can be provided.

The inventor has gotten a result of an experiment measuring noise levels of the blowing device 1 of the first embodiment and the blowing device without the counter flow introduction passage 24. The inventor has applied a power to the motors attached to the radiator and has measured the noise with a microphone placed at a position one meter apart from the outer rim of the fan shroud to a downstream side in regard to the air flow. The microphone is placed at the same height as the center of the fan. The noise is calculated with A-weighting.

According to the result of the experiment, the blowing device 1 of the first embodiment decreases peak values in frequency areas corresponding to respective order by 3 dB or more compared to the blowing device without the counter flow introduction passage 24. Accordingly, since the blowing device 1 of the first embodiment is capable of decreasing the level of the peak noise in low frequency areas to which people tend to feel bad, the rotation noise that may cause people to feel bad can be reduced.

The fan shroud 2 includes multiple specific rim portions in the outer rim 22. The counter flow introduction passage 24 extends from the inside parts of all of the specific rim portions of the air guide portion 23 in the rotation direction of the fan 3. According to these configurations, the counter flow introduction passage 24 is provided in all of multiple specific rim portions located around the ring portion 21. Therefore, multiple negative pressure areas that is likely to be generated around the ring portion 21 can be limited, and accordingly the pressure distribution around the ring portion 21 can be close to being uniform. Accordingly, the blowing device 1 limiting, for sure, the rotation noise that may be generated around the ring portion 21 can be provided.

When a leading portion (blade leading edge 30*a*) of one blade 30 in the rotation direction overlaps the tail end 24*b* of the counter flow introduction passage 24, a trailing portion (blade trailing edge 30*b*) of another blade 30 being next to and ahead of the one blade 30 does not overlap the counter flow introduction passage 24. The length of the counter flow introduction passage 24 in the circumferential direction is set to be such length.

According to these configurations, only one blade 30 overlaps one counter flow introduction passage 24 in the radial direction. Therefore, total length of blades 30 overlapping one counter flow introduction passage 24 can be constant regardless of the rotation of the fan 3. That is, a degree of overlap of the fan 3 to the counter flow introduction passage 24 as a whole can be constant even when the fan 3 rotates. Accordingly, a condition of the collision of the main air flow and the counter air flow can be stable, and the rotation noise can be limited continuously.

Moreover, the counter flow introduction passage 24 is defined by the through-hole 240 having a slit shape extending through the fan shroud 2. According to this configuration, the counter flow introduction passage 24 limiting a decrease in strength of the fan shroud 2 can be provided.

(Second Embodiment)

In a second embodiment, a counter flow introduction passage 24 in another form different from the first embodiment will be described referring to FIGS. 7 and 8. In the second embodiment, parts that are assigned the same reference numerals as the first embodiment and are not described below have the same configurations and the same effects as the first embodiment. In the second embodiment, only parts different from the first embodiment will be described. FIG. 8 is a diagram illustrating a counter flow introduction passage 24 that is partially sectioned.

Figure 7:
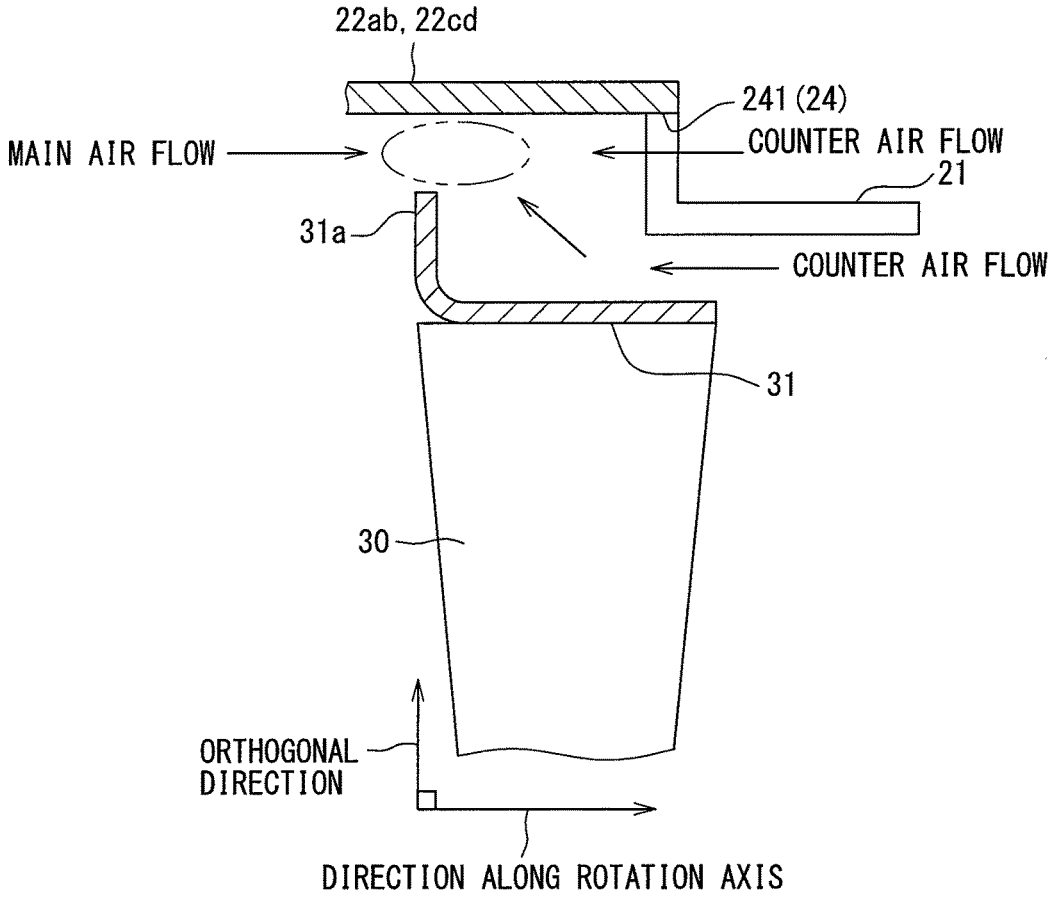
FIG. 7 is a sectional diagram illustrating a part of a counter air flow introduction passage of a blowing device according to a second embodiment of the present disclosure.
Figure 8:
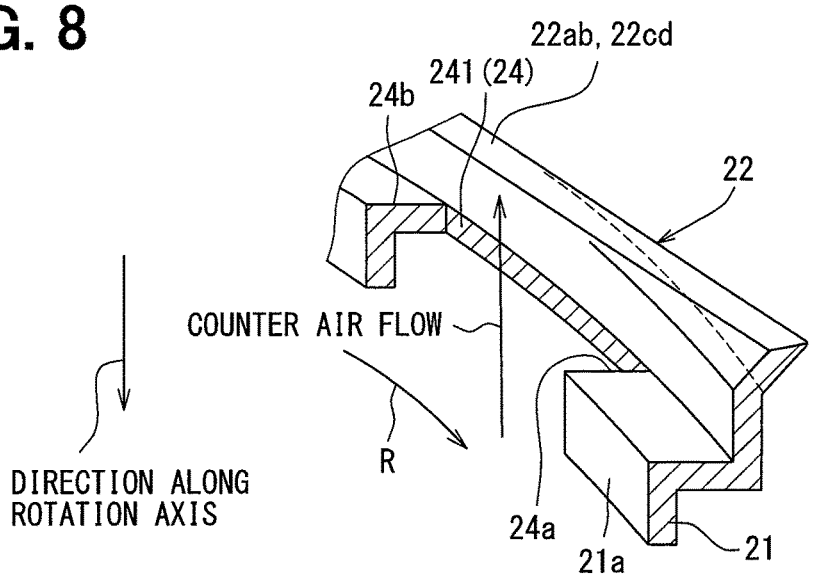
FIG. 8 is a diagram illustrating the counter air flow introduction passage and a vicinity of the counter air flow introduction passage according to the second embodiment.

As shown in FIGS. 7 and 8, the counter flow introduction passage 24 of the second embodiment is defined by an opening portion 241 in which a downstream edge of the ring portion 21 is notched. The counter flow introduction passage 24 may extend from the downstream edge of the ring portion 21 to the outer rim 22.

The counter flow introduction passage 24 of the second embodiment is capable of introducing the counter air flow from broad area extending from the downstream edge of the ring portion toward the upstream side. Accordingly, since the counter air flow flows in the broad area, an intensity of the collision with the main air flow is decreased, and the blowing device 1 that is capable of limiting the generation of the swirl can be obtained.

Although the present disclosure has been fully described in connection with the preferred embodiments thereof, it is to be noted that various changes and modifications will become apparent to those skilled in the art. The configurations of the above-described embodiments are just examples, and the scope of the present disclosure is not limited to the descriptions above.

In the above-described embodiments, the fan shroud 2 has a horizontally long rectangular shape in which the length in the up-down direction is larger than that in the left-right direction, but the fan shroud 2 is not limited to this shape. The fan shroud 2 may have a vertically long rectangular shape, a square shape, or a polygonal shape.

The counter flow introduction passage 24 may be provided in only one of the small area portion 23*ab* and the small area portion 23*cd*. In this case, the counter flow introduction passage 24 is provided in at least one of the small area portion 23*ab* and the small area portion 23*cd*, and the counter flow introduction passage 24 extends from the one of the small area portion 23*ab* and the small area portion 23*cd* in the rotation direction of the fan 3.

In the above-described embodiments, the blowing device 1 provides the cooling air to the radiator 4 cooling the engine cooling water of the vehicle, but the present disclosure is not limited to these embodiments. For example, the present disclosure can be applied to an air conditioner, a device being mounted to an outdoor unit of a water heater and providing a cooling air, a computer, or a device providing a cooling air cooling electronic components.

The blowing device 1 of the above-described embodiments is located downstream of the radiator 4, but the location of the blowing device is not limited to this. For example, the blowing device is located such that the air blown by the blowing device 1 is provided to the heat exchanger.

Shape, number, and position of the counter flow introduction passage 24 of the above-described embodiments is not limited to those described in the above-described embodiments.

Although the present disclosure has been described in connection with the preferred embodiments thereof, it is to be noted that various changes and modifications will become apparent to those skilled in the art. The present disclosure includes various changes and modifications within the equivalent. Moreover, other combinations and configurations, including more, less or only a single element, are also within the spirit and scope of the present disclosure.

What is claimed is:

1. A blowing device comprising:

an axial fan having a plurality of blades and causing an air to flow through a heat exchanger; and a fan shroud rotatably supporting the fan, wherein the fan shroud includes a ring portion having a cylindrical shape extending in a direction along a rotation axis of the fan, the ring portion surrounding a circumference of the fan with a gap between the circumference of the fan and the ring portion, an air guide portion connecting an outer rim of the fan shroud and an inner rim of the ring portion, the air guide portion guiding a drawn air drawn by the fan toward an inside of the ring portion, a specific rim portion that is a part of the outer rim of the fan shroud, a distance from the specific rim portion to the inner rim of the ring portion being shorter than other parts of the outer rim, and a counter flow introduction passage provided in the air guide portion and extending in a rotation direction of the fan from a position located inward of the specific rim portion, the counter flow introduction passage being located downstream of an upstream end of a tip of the fan, and the counter flow introduction passage is a passage through which the air flows in an opposite direction from a flow direction of the drawn air when the fan rotates.

2. A blowing device comprising:

an axial fan having a plurality of blades; and a fan shroud rotatably supporting the fan, wherein the fan shroud includes a ring portion having a cylindrical shape extending in a direction along a rotation axis of the fan, the ring portion surrounding a circumference of the fan with a gap between the circumference of the fan and the ring portion, an air guide portion connecting an outer rim of the fan shroud and an inner rim of the ring portion, the air guide portion guiding a drawn air drawn by the fan toward an inside of the ring portion, a specific rim portion that is a part of the outer rim of the fan shroud, a distance from the specific rim portion to the inner rim of the ring portion being shorter than other parts of the outer rim, and a counter flow introduction passage provided in the air guide portion and extending in a rotation direction of the fan from a position located inward of the specific rim portion, the counter flow introduction passage being located downstream of an upstream end of a tip of the fan, and the counter flow introduction passage is a passage through which the air flows in an opposite direction from a flow direction of the drawn air when the fan rotates.

3. The blowing device according to claim 1, wherein the specific rim portion is one of a plurality of specific rim portions, and the distances from the plurality of specific rim portions to the inner rim of the ring portion are shorter than distances from other parts of the outer rim of the fan shroud to the inner rim, the counter flow introduction passage is provided in the air guide portion and extends in the rotation direction of the fan from the position located inward of each of the plurality of specific rim portions.

4. The blowing device according to claim 1, wherein a length of the counter flow introduction passage in a circumferential direction is set such that when a leading edge of one of the plurality of blades overlaps a tail end that is an opposite end of the counter flow introduction passage in the rotation direction, a trailing edge of another one of the plurality of blades next to and ahead of the one of the plurality of blades does not overlap the counter flow introduction passage, the trailing edge being an opposite edge of the plurality of blades in the rotation direction.

5. The blowing device according to claim 1, wherein the counter flow introduction passage includes a through-hole having a slit shape and extending through the fan shroud.

6. The blowing device according to claim 1, wherein the counter flow introduction passage includes an opening portion in which a downstream edge of the ring portion is notched.

7. The blowing device according to claim 1, wherein a distance between two of the plurality of blades next to each other in a rotation direction is longer than a length of the counter flow introduction passage in the rotation direction.

8. The blowing device according to claim 7, wherein the distance in the rotation direction between the two of the plurality of blades next to each other is a distance between radially outermost parts of the two of the plurality of blades.

9. The blowing device according to claim 2, wherein the specific rim portion is one of a plurality of specific rim portions, and the distances from the plurality of specific rim portions to the inner rim of the ring portion are shorter than distances from other parts of the outer rim of the fan shroud to the inner rim, the counter flow introduction passage is provided in the air guide portion and extends in the rotation direction of the fan from the position located inward of each of the plurality of specific rim portions.

10. The blowing device according to claim 2, wherein a length of the counter flow introduction passage in a circumferential direction is set such that when a leading edge of one of the plurality of blades overlaps a tail end that is an opposite end of the counter flow introduction passage in the rotation direction, a trailing edge of another one of the plurality of blades next to and ahead of the one of the plurality of blades does not overlap the counter flow introduction passage, the trailing edge being an opposite edge of the plurality of blades in the rotation direction.

11. The blowing device according to claim 2, wherein the counter flow introduction passage includes a through-hole having a slit shape and extending through the fan shroud.

12. The blowing device according to claim 2, wherein the counter flow introduction passage includes an opening portion in which a downstream edge of the ring portion is notched.

13. The blowing device according to claim 2, wherein a distance between two of the plurality of blades next to each other in a rotation direction is longer than a length of the counter flow introduction passage in the rotation direction.

14. The blowing device according to claim 13, wherein the distance in the rotation direction between the two of the plurality of blades next to each other is a distance between radially outermost parts of the two of the plurality of blades.

* * * * *